US009334617B2

(12) United States Patent
Caraballo Benitez et al.

(10) Patent No.: US 9,334,617 B2
(45) Date of Patent: May 10, 2016

(54) POLLUTION CONTROL VESSEL

(75) Inventors: Jose Caraballo Benitez, Seville (ES); Jose Ma Del Pino Lopez-Ontiveros, Seville (ES); Rosendo Augusto Ibanez, Seville (ES); Eduardo Relinque Gallardo, Seville (ES)

(73) Assignee: Jose Caraballo Benitez, Sevilla (ES)

( * ) Notice: Subject to any disclaimer, the term of this patent is extended or adjusted under 35 U.S.C. 154(b) by 308 days.

(21) Appl. No.: 13/982,075

(22) PCT Filed: Jan. 19, 2012

(86) PCT No.: PCT/ES2012/070028

§ 371 (c)(1),
(2), (4) Date: Oct. 10, 2013

(87) PCT Pub. No.: WO2012/101304

PCT Pub. Date: Aug. 2, 2012

(65) Prior Publication Data

US 2014/0021113 A1 Jan. 23, 2014

(30) Foreign Application Priority Data

Jan. 27, 2011 (ES) ..... 201130107

(51) Int. Cl.
*E02B 15/04* (2006.01)
*E02B 15/10* (2006.01)
*B63B 35/32* (2006.01)

(52) U.S. Cl.
CPC ..... *E02B 15/046* (2013.01); *B63B 35/32* (2013.01); *E02B 15/105* (2013.01)

(58) Field of Classification Search
CPC ... E02B 15/046; E02B 15/048; E02B 15/105; B63B 35/32
USPC ..... 210/170.09, 170.1, 170.11, 242.1, 210/242.3, 923
See application file for complete search history.

(56) References Cited

U.S. PATENT DOCUMENTS 3,268,081 A * 8/1966 Menkee et al. ..... 210/242.1
3,615,017 A 10/1971 Valdespino (Continued)

FOREIGN PATENT DOCUMENTS

DE 2819521 8/1979
DE 19914113 A1 12/2000

(Continued)

*Primary Examiner* — Christopher Upton
(74) *Attorney, Agent, or Firm* — Hayes Soloway, P.C.

(57) ABSTRACT

Catamaran-type boat for collecting waste (petroleum, oils, rubbish, algae, etc.), of those comprised by two parallel and longitudinal hulls, wherebetween is defined a tunnel wherethrough water flows, a control bridge, and at least one fuel tank for servicing a main engine, fundamentally standing out in that it permits access thereof to very shallow areas, and in that once said waste has been collected and filtered, it is packaged in bags and tossed back into the water for its subsequent collection or towing by auxiliary boats, allowing the ship to be used continuously in a greater number of situations; additionally permitting the configuration of the ship for "open sea" waste collection, and a configuration of the ship for "coastal areas", rivers, marshes or suchlike.

13 Claims, 8 Drawing Sheets

(56) References Cited

U.S. PATENT DOCUMENTS

| | | | | | |
|---|---|---|---|---|---|
| 3,966,615 | A | | 6/1976 | Petchul et al. | |
| 4,456,536 | A | * | 6/1984 | Lorenz et al. | 210/242.3 |
| 4,976,855 | A | * | 12/1990 | Virtanen | 210/242.3 |
| 5,019,277 | A | * | 5/1991 | Andelin | 210/242.3 |
| 5,160,638 | A | * | 11/1992 | Petkovic | 210/923 |
| 5,173,185 | A | * | 12/1992 | Stokes | 210/242.3 |
| 5,254,266 | A | | 10/1993 | Barnes et al. | |
| 2011/0011784 | A1 | * | 1/2011 | Zori-Garcia | 210/242.3 |
| 2012/0152817 | A1 | * | 6/2012 | Dague | 210/242.3 |

FOREIGN PATENT DOCUMENTS

| | | | | |
|---|---|---|---|---|
| DE | 102008055633 | A1 | | 5/2010 |
| ES | 250687 | | | 5/1980 |
| ES | 1015065 | | | 5/1991 |
| ES | 2161577 | | | 12/2001 |
| JP | 5133461 | | * | 1/2013 |

* cited by examiner

POLLUTION CONTROL VESSEL

OBJECT OF THE INVENTION

The present invention relates to the shipbuilding sector, and more specifically to floating boats, ships or suchlike, equipped with means for collecting floating waste and/or polluting materials on the surface of the water.

The main object of the present invention is an anti-pollution ship, of the catamaran type, which fundamentally stands out for having a waste collecting, filtering, decanting and bagging system with an unlimited loading capacity, the ship further being able to operate in and gain access to very shallow areas.

BACKGROUND OF THE INVENTION

Currently a multitude of boats are known that incorporate dredging systems and/or waste collecting means with the purpose of cleaning coasts, rivers, marshes, internal waters, etc. More specifically, for the case of cleaning sea beds, there are boats made up of a dredge which performs its task on the bottom, lifting the collected material to the surface and depositing it in a container to subsequently be taken away to a suitable place.

On the other hand, concerning the cleaning of coastal and river surfaces, there also exist boats provided with means for collecting all types of waste, petroleum spills, oils and rubbish. It has been proven that 1 $m^3$ of hydrocarbon can form a stain 100 m in diameter, with a thickness of 1 mm, in scarcely 90 minutes.

A known system for cleaning ports, marshes and reservoirs is that wherein a boat incorporates a collection basket submerged in the water surface, so that as the boat advances, solid wastes enter the basket, which is lifted to the boat every certain amount of time, to be emptied.

This system features two basic drawbacks: one of them consists of the fact that the collection of the basket is carried out manually, and due to the heavy weight thereof, the removal of the basket and placement thereof on the boat is very problematic, requiring very demanding physical strength. On the other hand, the basket in question is equipped with a large orifice wherethrough the solid waste enters but, likewise, due to the effect of the waves, said waste can exit the basket before it is collected, because, as mentioned above, it is only collected periodically. It also must not be forgotten that when the basket is on the surface of the boat, waste continues to pass underneath the hull of the boat, and it obviously cannot be collected.

Another system for the cleaning of ports and suchlike consists of a boat which incorporates a "spoon", situated at water level, on the frontal part thereof, so that as the boat advances, solid waste is introduced therein.

Said system features the same drawbacks as the first system mentioned above, i.e., when the spoon is taken off of the water surface to dump the waste in a suitable container, the boat continues to move and the waste present on the surface of the water cannot be collected. Furthermore, and given that the spoon tends to be large, the dumping of the rubbish into the container is performed either when the spoon is full or periodically, some waste occasionally leaving the spoon due to the effect of the waves.

More specifically, Spanish patent ES2161577, as well as utility models ES1015065 and ES250687, disclose boats of the "catamaran" type for cleaning surfaces in rivers, marshes and internal waters. Said boats incorporate a sliding platform or conveyor belt, sloped and ascending, by means whereof waste and/or spills that are floating on the surface of the water are continuously collected and filtered. This waste is housed in a container which is subsequently emptied once arriving ashore.

The technical drawback proposed herein is that all of the previously mentioned boats require large tanks or stores where the collected waste can temporarily be housed until the final deposit thereof in containers on shore. Said storage waste tanks are enormous, which directly influences the total size of the ship, making its transport and manoeuvrability very problematic, preventing the access thereof to shallow places and thus limiting its use. Additionally, the considerable economic costs derived from the consumption of fuel of these large boats must be highlighted.

DESCRIPTION OF THE INVENTION

The aforementioned drawbacks are resolved by means of the present invention, providing an anti-pollution ship, of the catamaran type, for collecting waste (crude oil, oils, rubbish, algae, etc.), by means whereof once the waste is collected, filtered, decanted and lifted, it is bagged and thrown back into the water for its subsequent collection or towing by auxiliary boats, permitting the ship to be used continuously and in a greater number of situations, such as cleaning tasks of port waters, algae or jellyfish collection in coastal areas, cleaning of rivers, etc.

The anti-pollution ship object of the invention also stands out for its capacity to access and enter very shallow places, due to its reduced dimensions, achieved as a consequence of not requiring huge waste storage tanks, unlike currently existing cleaning vessels and boats. The anti-pollution ship disclosed herein is a catamaran-type boat, of those formed by two parallel and longitudinal hulls, wherebetween is defined a space or tunnel wherethrough water flows without turbulence, at least one fuel tank for servicing a main engine, and a control bridge where the navigation and direction controls of the ship are located.

The anti-pollution ship of the present invention fundamentally sets itself apart for comprising:

- a waste collection tray disposed in the defined tunnel between the two hulls of the ship, adapted to collect and filter waste present on the surface of the water,
- at least one longitudinal screw conveyor connected to the collection tray, which causes vacuum currents inside the tunnel, and which lifts the waste to a collector disposed on the rear part of the collection tray, and whereon said longitudinal screw conveyor rests,
- a decantation chamber disposed below the collector, which permits the collection of the remaining waste not previously collected by the longitudinal screw conveyor,
- at least one vacuum pump connected to the collector, adapted to transport the waste housed in the decantation chamber and lift it to its final position inside the collector, and
- valves, connected to the collector, wherethrough the waste exits for its final unloading in collection bags, intended to be closed and numbered for their subsequent tossing into the water where an auxiliary boat will pick them up.

According to a preferred embodiment of the invention, the collection tray additionally comprises drainage orifices disposed on the vertical and rear face of the tray, under the decantation chamber, wherethrough the decanted water free of waste will be released. The main function of these orifices is to keep a sufficient water level inside the collection tray to permit the transport of the waste to the collector. Preferably, said drainage orifices have closure means to permit a total or partial closure of the orifices depending on whether more or less water is required inside the collection tray.

Furthermore, it has been provided that the collection tray can be lifted or lowered at will depending on the viscosity of the dump, as it needs more or less water to be lifted and bagged. Therefore, the collection tray preferably has lower apertures arranged along the surface thereof also equipped with closure means in order to accelerate the lowering of the tray, especially in very shallow areas.

According to another preferred embodiment of the invention, the anti-pollution ship additionally comprises cross-drive screw conveyors, arranged near the bow, which permit the production of a vacuum current towards the interior of the tunnel, facilitating the collection of all types of waste (liquid and solid) in areas where there is not a current or that are very shallow.

Preferably, both the longitudinal and cross-drive screw conveyors are detachable, so that it is possible to choose between a configuration of the ship for collecting waste in "open sea", and a configuration of the ship for collecting waste along "coasts", rivers or shallow zones. Likewise, it must be pointed out that the ship object of the invention is adapted for the collection of waste both while moving and when stopped, to this end using the joint action of the main engine with its line of drive shafts, and auxiliary engines with its line of lateral shafts, which produce an artificial water flow which keeps the ship in place.

On the other hand, the incorporation of supporting frames, by means whereof the collection tray is connected to the hulls of the ship, has been provided. Preferably, said supporting frames are equipped with hydraulic means for the lifting or lowering of the collection tray, in order to make it go shallower or deeper into the water depending on the type of waste to be collected.

Additionally, high pressure, hot water spray guns are disposed on the deck of the ship for cleaning docks, thus complementing the continuous use of the prior point, as well as oily water separating equipment for the portside cleaning of the bilges of the boats and sewage separating equipment for disposing of waste from small ships.

Finally, and optionally, a security system has been incorporated to prevent the production of sparks in the engine exhaust gases, avoiding any possibility of fire due to contact or reaction with the fuel tank of the ship of crude oil waste, as well as a covered oxygen inlet system, in case it were necessary for the crew to work in polluted environments.

Therefore, the anti-pollution ship of the present invention considerably optimizes current waste collecting systems, as it can act in places where the large majority of ships cannot gain access, due to size and depth. Furthermore, it is intended to be used continuously, without its use being limited to total emergency situations such as open sea oil spills, accidental leaks due to shipwrecks or suchlike, as it can be used for cleaning docks, boats, beaches and collecting waste created by vessels themselves in their daily activity.

DESCRIPTION OF THE DRAWINGS

To complete the description that is being made, and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

PREFERRED EMBODIMENT OF THE INVENTION

An example of preferred embodiment is described below, citing the aforementioned figures, without limiting the protective scope of the present invention.

Figure 1:
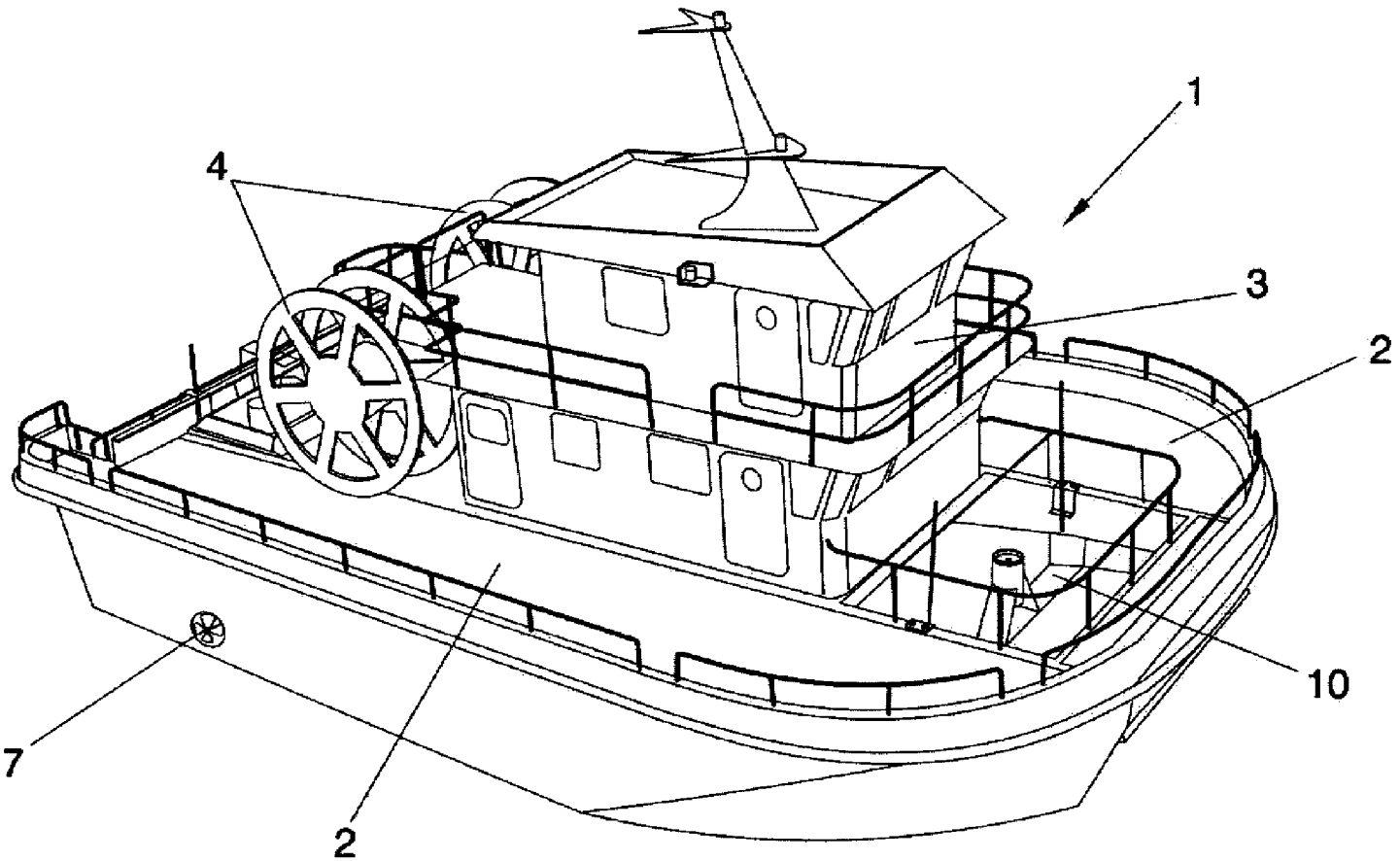
FIG. 1.—Shows a general perspective view of the anti-pollution ship object of the invention.

FIG. 1 shows an anti-pollution ship (1) of the catamaran type, of those that comprise two parallel hulls (2), longitudinal and straight on the inner face thereof, wherebetween a tunnel is defined wherethrough water freely flows, at least one fuel tank (5) for servicing a main engine (6) equipped with drive shafts, and a control bridge (3) where the navigation and direction controls of the ship (1) are located.

Figure 2:
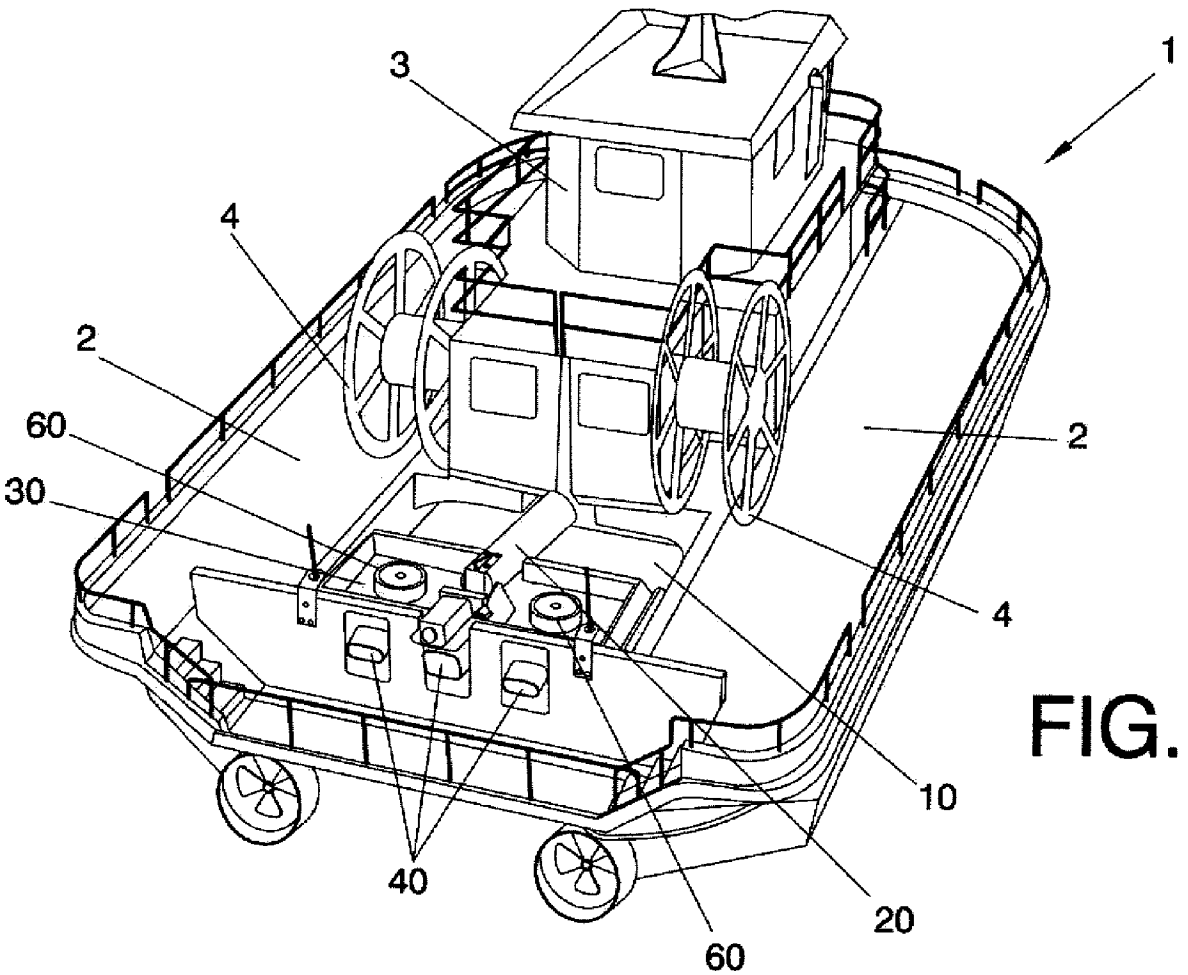
FIG. 2.—Shows a rear perspective view of the anti-pollution ship.
Figure 3:
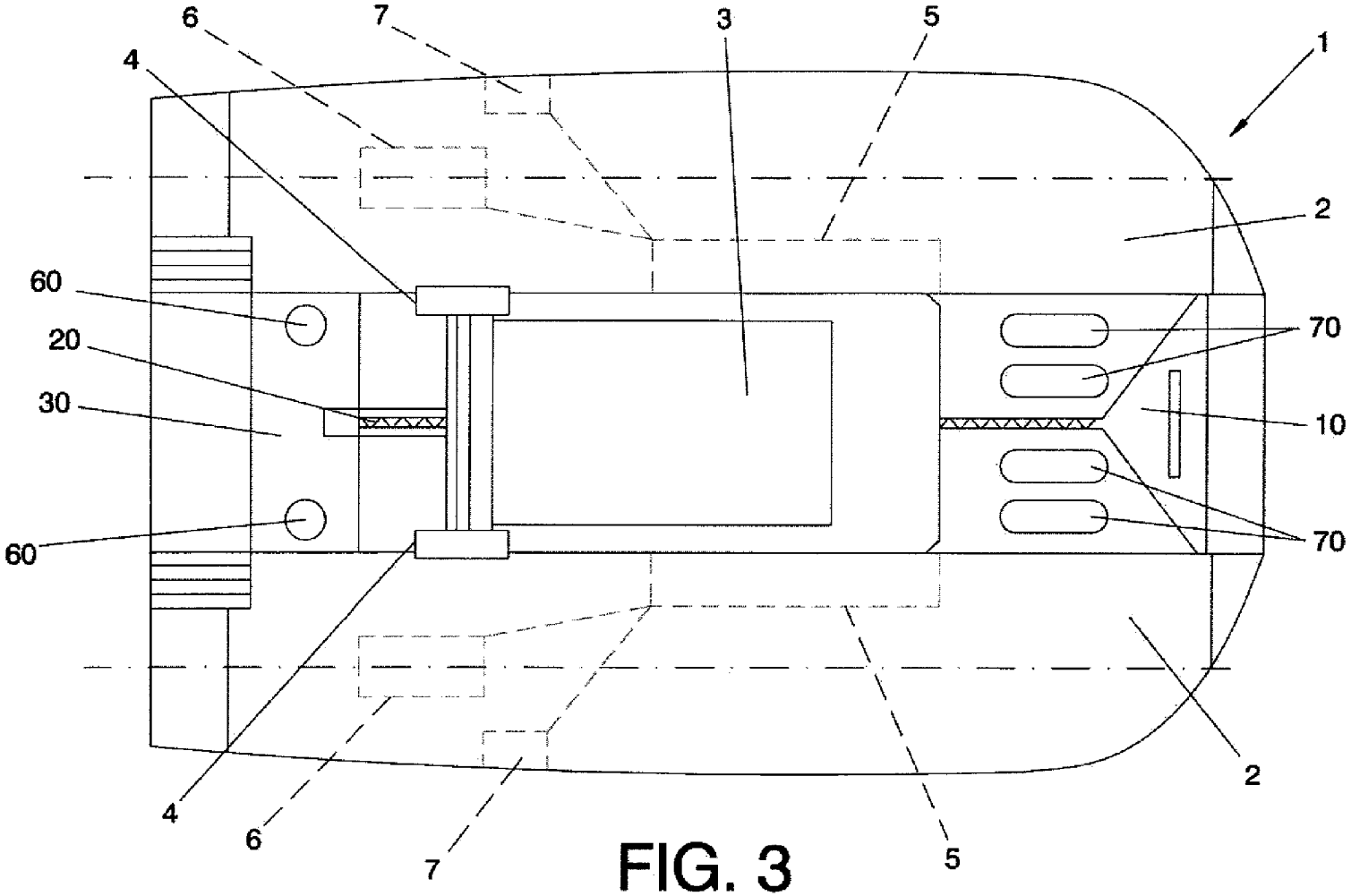
FIG. 3.—Shows a plan view of the anti-pollution ship.
Figure 4:
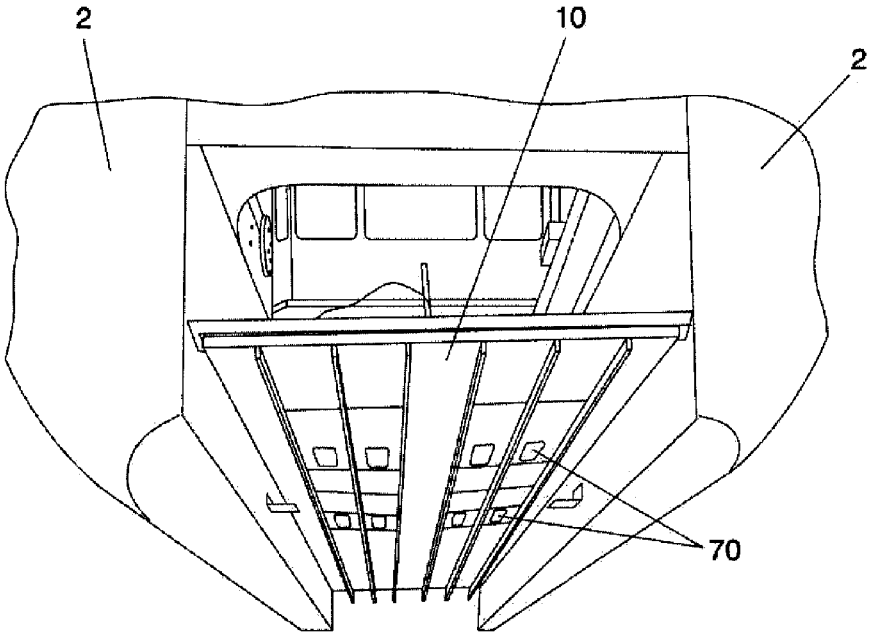
FIG. 4.—Shows a view of the lower area of the ship where the collection tray is observed with its lower apertures to facilitate the lowering thereof in shallow areas.
Figure 5:
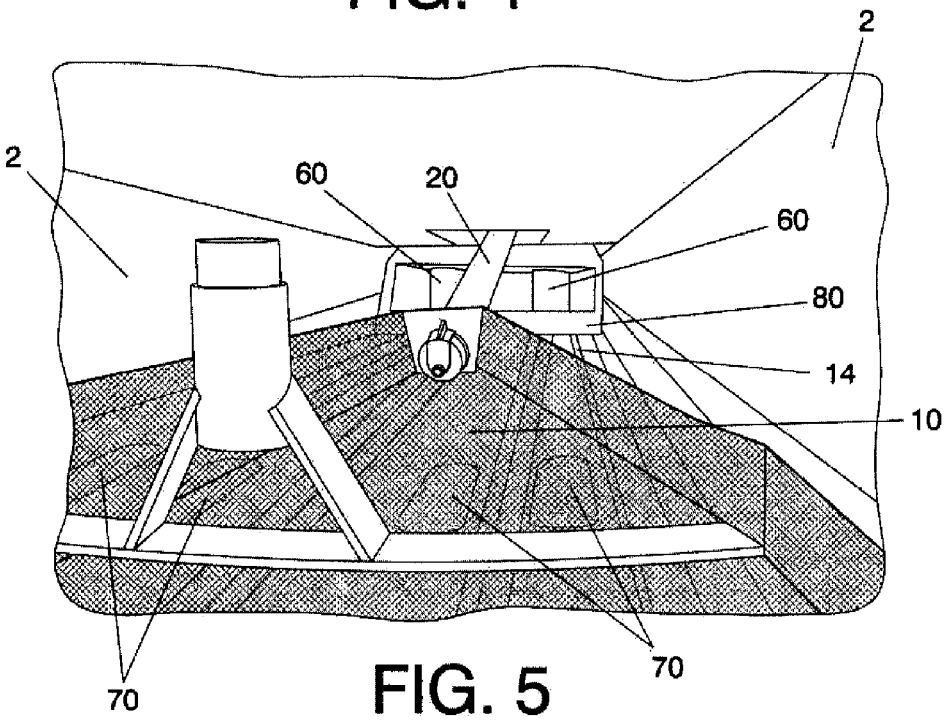
FIG. 5.—Shows a frontal view of the collection tray situated between the two hulls of the ship, and where a longitudinal screw conveyor is observed for lifting crude oil to the collector.

According to a first preferred embodiment, shown in FIGS. 1 to 5, the anti-pollution ship (1) comprises:

- a waste collection tray (10) disposed in the defined tunnel between the two hulls (2) of the ship (1), adapted to collect and filter waste present on the surface of the water,
- a longitudinal screw conveyor (20) shown in FIGS. 2, 3 and 5, which is connected to the collection tray (10) and the function whereof is to cause vacuum currents inside the tunnel, and to lift the waste to a collector (30) disposed on the rear part of the collection tray (10), and whereon said longitudinal screw conveyor (20) rests,
- a decantation chamber (80), shown in FIG. 5, disposed below the collector (30), which collects the waste not previously transported by the longitudinal screw conveyor (20),
- two vacuum pumps (60), shown in FIGS. 2, 3 and 5, connected to the collector (30) and which are adapted to transport the waste housed in the decantation chamber (80) and lift it to its final position inside the collector (30), and
- valves (40) connected to the collector (30), wherethrough the waste exits for its final unloading in disposable plastic bags, intended to contain said waste for its subsequent closure by means of clamping, numbering and tossing into the water, where an auxiliary boat will pick them up or tow them.

Furthermore, as represented in FIGS. 1, 2 and 3, the collection tray (10) further comprises drainage orifices (13) disposed on the vertical rear face thereof, which permit to keep a sufficient water level inside the collection tray (10) to be able to suitably filter and separate the water-waste mixture. Said drainage orifices (13) have closure means, not represented, to make a total or partial closure of the orifices possible, depending on whether more or less water is required inside the collection tray (10). Likewise, the existence of lower apertures (70), shown in FIGS. 3, 4 and 5, has been provided, arranged along the surface of the collection tray (10), which facilitate and accelerate the lowering of the tray (10), especially in very shallow areas.

Likewise, it should be highlighted that the ship (1) object of the invention is adapted for the collection of waste both while moving and when stopped, using to this end the joint action of the main engine (6) with its drive shafts in bow-stern direction, as represented in FIG. 3, and auxiliary engines (7) with their drive shafts open 45° on each side, which produce an artificial water flow in bow-stern direction which keeps the ship (1) still where it might be necessary to keep the ship in a fully stopped position.

The unlimited load capacity which allows the ship (1) should also be noted, as long as packaging bags are being supplied, which are initially disposed and collected on reels (4) represented in FIGS. 1 and 2, situated in the rear part of the ship (1). The fact that the bags are numbered has been planned so that, when it is time for the auxiliary boat to collect them, none of them are lost, floating adrift.

Figure 6:
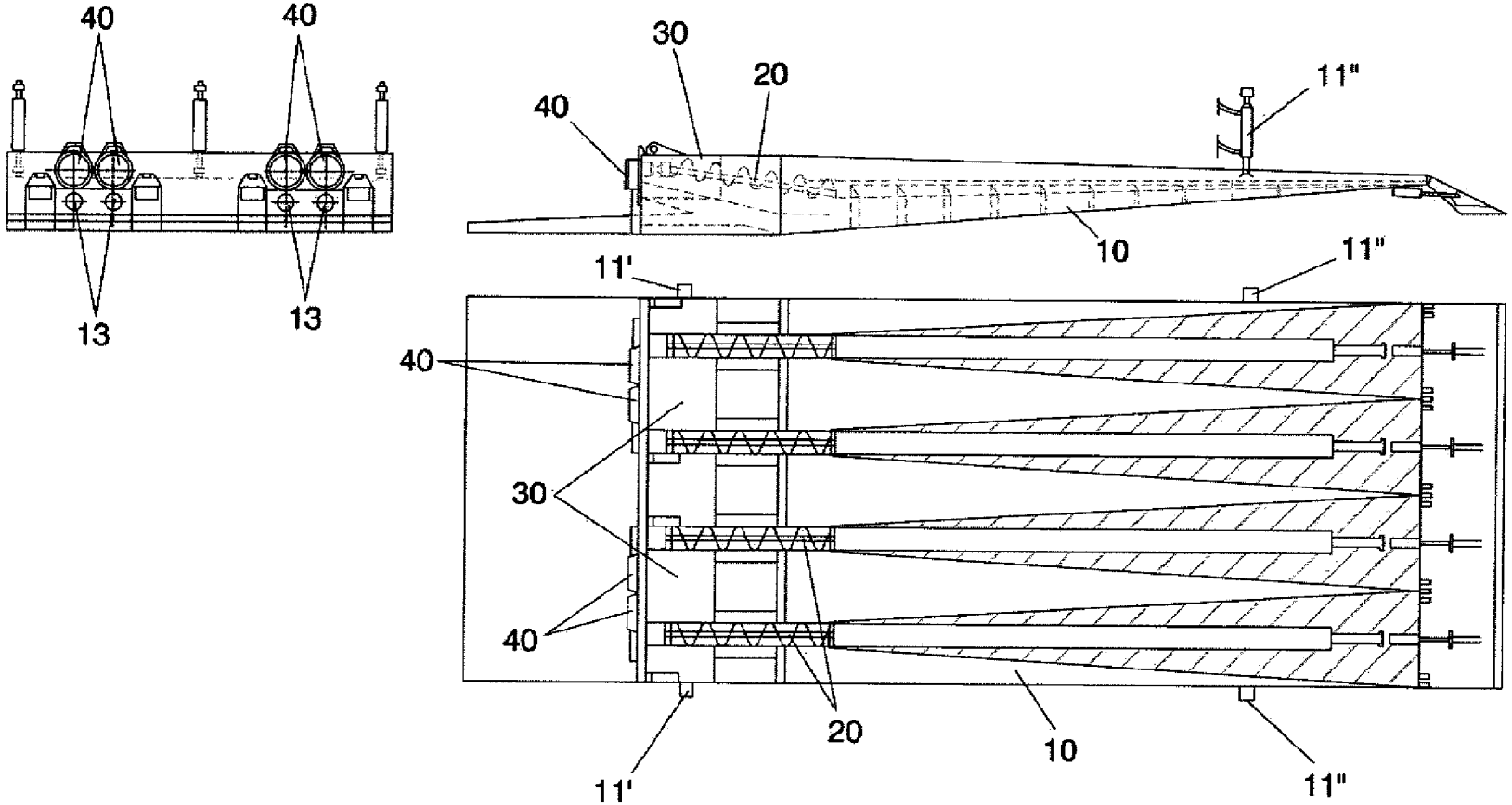
FIG. 6.—Shows views of the ship configured for open sea collection.

According to a second preferred embodiment, shown in FIG. 6, the anti-pollution ship (1) is observed wherein it is configured for collecting waste at "open sea", where the ship (1) shall remain in constant movement and where it is necessary to have several longitudinal screw conveyors (20) to transport and lift the filtered waste to the collector (30) more quickly.

Figure 7:
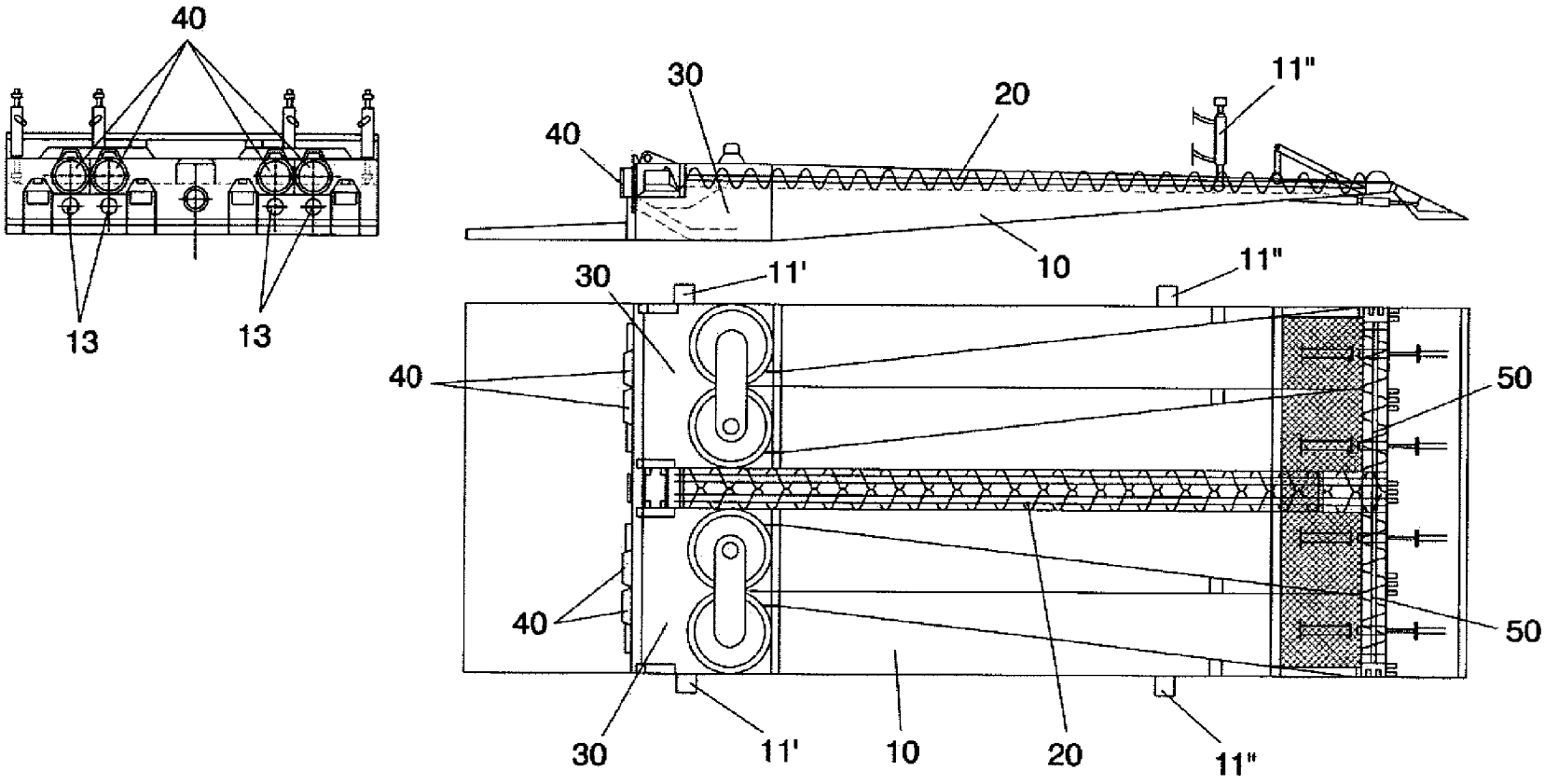
FIG. 7.—Shows plan views of the ship configured for collection in shallow and coastal zones.

On the other hand, according to a third preferred embodiment of the invention, represented in FIG. 7, the ship (1) is observed configured for the use thereof in coastal or shallow areas, such as rivers, marshes, etc., using for this purpose cross-drive screw conveyors (50), situated near the bow of the ship (1), by means whereof it is possible to collect solid elements mixed with crude oil due to the proximity thereof to the coast, where they tend to be more abundant.

Figure 10:
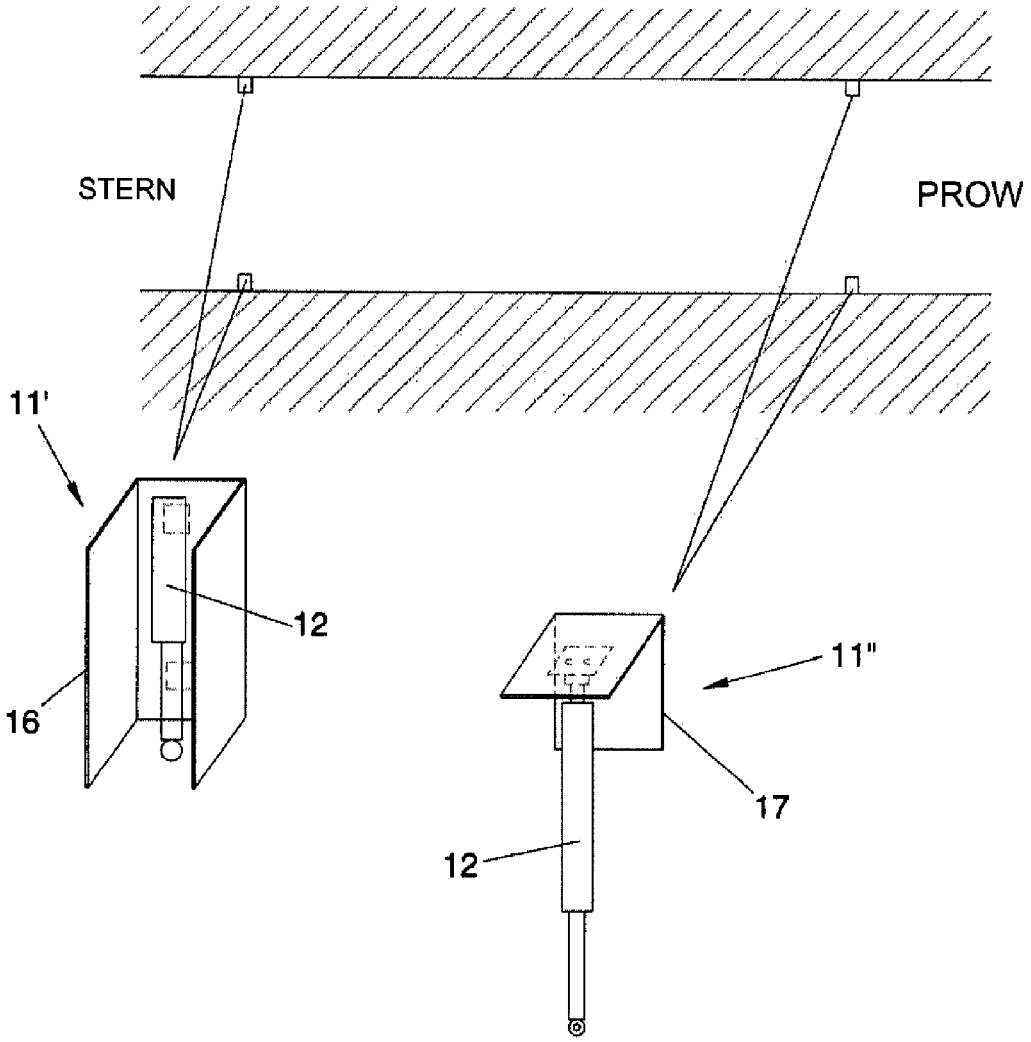
FIG. 10.—Shows a perspective view of the bow and stern supporting frames responsible for lifting and lowering the collection tray.

As can be observed in FIGS. 6 and 7, the collection tray (10) is fastened to the hulls (2) by means of supporting frames (11', 11") disposed both on the front part and rear part thereof, on both sides of said collection tray (10). These supporting frames (11', 11"), represented in greater detail in FIG. 10, have hydraulic means (12) by means whereof the collection tray (10) is lifted or lowered to situate it on the water-waste interface. It has been provided that the rear supporting frames (11') comprise protective guides (16), which, besides surrounding and protecting the hydraulic means (12), also serve to prevent the collection tray (10) from swinging as it is raised and lowered. On the other hand, the front supporting frames (11") do not feature guides (16), but rather only have a bracket (17), in order to permit certain swinging movement of the collection tray (10).

Figure 8:
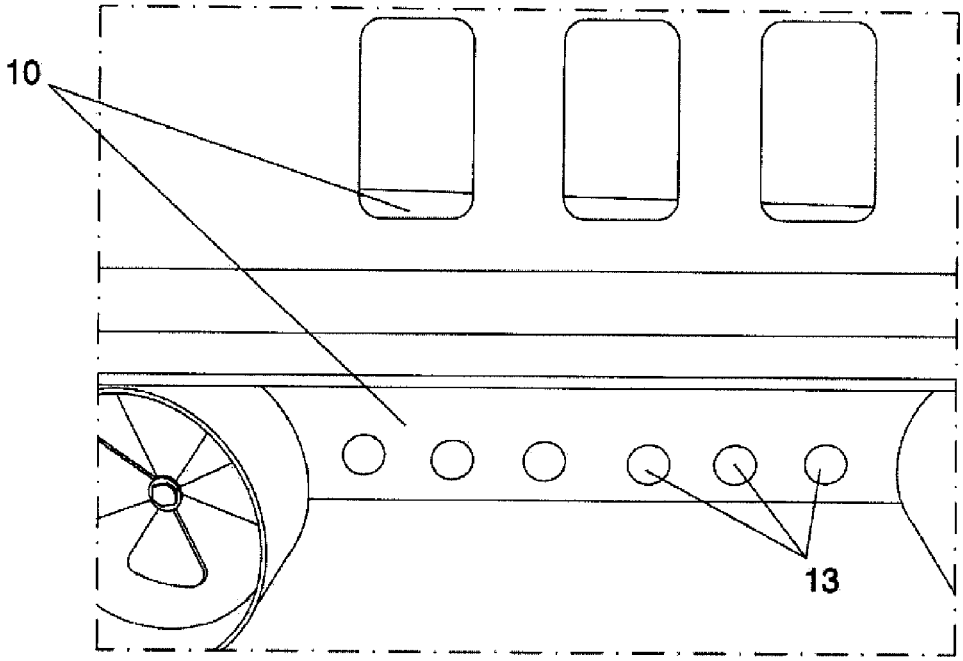
FIG. 8.—Shows a frontal rear view of the ship where the drainage orifices of the collection tray are observed.

FIG. 8 shows a view of the lower rear zone of the ship (1), and wherein the collection tray (10) can be observed with six drainage orifices (13) wherethrough more or less water is allowed to pass to always keep the appropriate amount of water in the inside of the collection tray (10) to be able to suitably filter and separate the water-waste mixture. According to a preferred embodiment, the opening and closing of these drainage orifices (13) is carried out through automatic means, with a guillotine-type closure.

Figure 9:
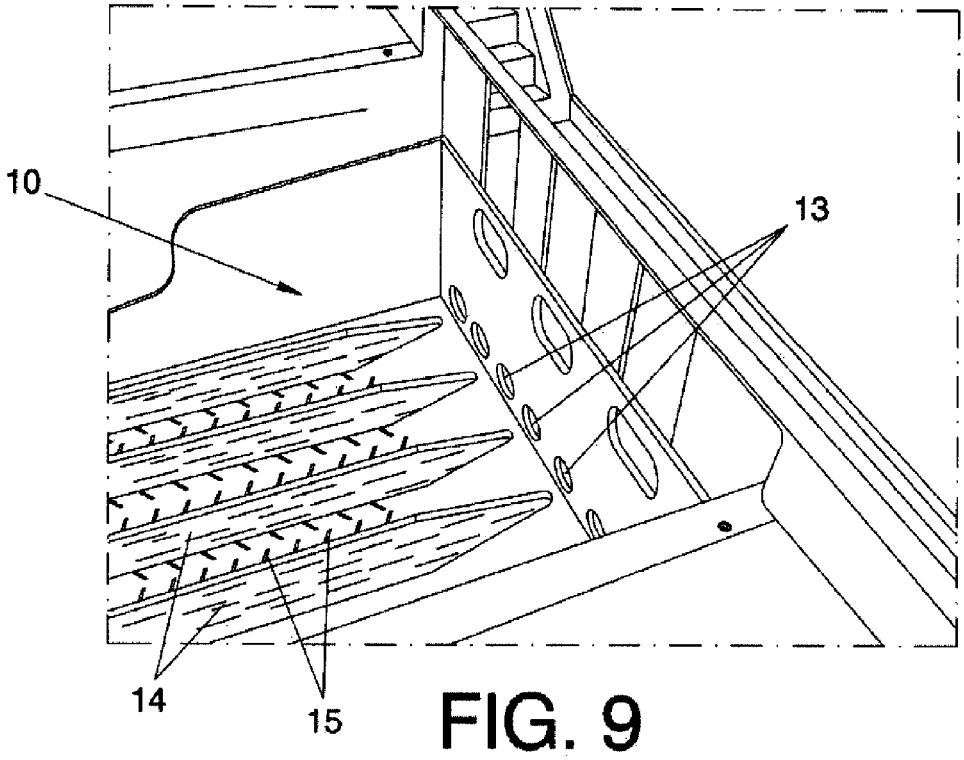
FIG. 9.—Shows a view of the inside of the collection tray, wherein its channels, breakwaters and drainage orifices are represented.

For its part, FIG. 9 represents a view of the rear part of the collection tray (10), which shows channels (14) for channelling water, breakwaters (15) existing between said channels (14) to permit the acceleration of the water-waste separation.

The invention claimed is:

1. An anti-pollution ship for the collection of waste, such as petroleum, oil, rubbish, algae or suchlike, the ship comprising:
- two parallel and longitudinal hulls, wherebetween is defined a space or tunnel configured so as to allow water freely flowing wherethrough,
- at least one fuel tank for servicing a main engine, and
- a control bridge where the navigation and direction controls of the ship are located, the ship further comprising:
- a waste collection tray disposed in the tunnel between the two hulls of the ship, and adapted to collect and filter waste present on the surface of the water,
- at least one longitudinal screw conveyor connected to the collection tray, for causing vacuum currents inside the tunnel, and for lifting at least part of the waste to a collector disposed on the rear part of the collection tray, the screw leaning on the collector,
- a decantation chamber disposed below the collector, and communicated with the collection tray, for collecting, from the tray, at least part of remaining waste not collected by the longitudinal screw conveyor,
- at least one vacuum pump connected to the collector, adapted to transport the waste housed in the decantation chamber by lifting the waste up to a final position inside the collector, and
- valves, connected to the collector, for allowing the waste exit wherethrough for a final unloading of the waste in collection bags, the bags being intended to be closed and numbered for their subsequent tossing into the water so as to be picked up by an auxiliary boat.

2. The ship of claim 1, further comprising cross-drive screw conveyors configured to produce a vacuum current towards the inside of the tunnel, for collecting waste in areas without currents or very shallow areas.

3. The ship of claim 2 wherein the cross-drive endless screw conveyors are situated near the bow of the ship.

4. The ship of claim 2, wherein both the longitudinal screw conveyor and the cross-drive screw conveyors are detachable, so as to define selectable first configuration of the ship for collecting waste in "open sea", and second configuration of the ship for collecting waste along "coasts", rivers or shallow areas.

5. The ship of claim 2, wherein both the longitudinal screw conveyor and the cross-drive screw conveyors are detachable, so as to define selectable first configuration of the ship for collecting waste in "open sea", and second configuration of the ship for collecting waste along "coasts", rivers or shallow areas.

6. The ship of claim 1, wherein the collection tray is connected to the hulls of the ship by means of support frames.

7. The ship of claim 6, wherein the support frames comprise hydraulic means for lifting or lowering the collection tray for situating the collection tray on a water-waste interface.

8. The ship of claim 7, wherein the support frames comprise rear support frames comprising protective surrounding guides, for protecting the hydraulic means and preventing the collection tray from swinging when raised or lowered.

9. The ship of claim 6, wherein the support frames comprise frontal support frames which are connected to the hulls of the ship only by a bracket, the bracket being configured so as to permit swinging movement of the collection tray.

10. The ship of claim 1, wherein the collection tray comprises drainage orifices situated in a rear area of the collection tray, for allowing to keep a sufficient water level in the inside of the collection tray so as to permit the transport of the waste to the collector.

11. The ship of claim 10, wherein the drainage orifices have closure means adapted to permit a total or partial closure of the orifices depending on whether more or less water is required inside the collection tray.

12. The ship of claim 1, wherein the collection tray further comprises channels for channeling water.

13. The ship of claim 12, wherein the collection tray further comprises breakwaters disposed between the channels, for accelerating the separation of the water-waste mixture.

* * * * *